US005892321A

United States Patent [19]

Itoh et al.

[11] Patent Number: 5,892,321

[45] Date of Patent: Apr. 6, 1999

[54] FIELD EMISSION CATHODE AND METHOD FOR MANUFACTURING SAME

[75] Inventors: Shigeo Itoh; Tatsuo Yamaura; Takahiro Niiyama, all of Mobara, Japan

[73] Assignee: Futaba Denshi Kogyo K.K., Mobara, Japan

[21] Appl. No.: 791,744

[22] Filed: Jan. 30, 1997

[30] Foreign Application Priority Data

Feb. 8, 1996 [JP] Japan ..... 8-045634

[51] Int. Cl.[6] ..... H01J 1/30

[52] U.S. Cl. ..... 313/336; 313/309; 313/351; 313/495

[58] Field of Search ..... 313/309, 351, 313/336, 495; 445/24, 50, 51, 35

[56] References Cited

U.S. PATENT DOCUMENTS

| | | | |
|---|---|---|---|
| 5,194,780 | 3/1993 | Meyer | 313/336 |
| 5,502,347 | 3/1996 | Dworsky et al. | 313/336 |
| 5,557,159 | 9/1996 | Taylor et al. | 313/336 |
| 5,594,298 | 1/1997 | Itoh et al. | 313/351 |

*Primary Examiner*—Nimeshkumar Patel

*Attorney, Agent, or Firm*—Oblon, Spivak, McClelland, Maier & Neustadt, P.C.

[57] ABSTRACT

A field emission cathode capable of preventing an increase in emission current discharged from conical emitters due to a variation in environmental temperature. The field emission cathode includes a resistive layer structure, which is constructed of two resistive layers different in temperature charactertistics. Such construction substantially prevents a variation in resistance of the whole resistive layer strcuture due to an increase in environmental temperature.

6 Claims, 6 Drawing Sheets

FIELD EMISSION CATHODE AND METHOD FOR MANUFACTURING SAME

BACKGROUND OF THE INVENTION

This invention relates to field emission cathode techniques, and more particularly to a field emission cathode known to be a cold cathode in the art and a method for manufacturing the same.

When an electric field set to be about $10^9$ (V/m) is applied to a surface of a metal material or that of a semiconductor material, a tunnel effect occurs to permit electrons to pass through a barrier, resulting in the electrons being discharged to a vacuum even at a normal temperature. Such a phenomenon is referred to as "field emission" in the art and a cathode constructed so as to emit electrons based on such a principle is referred to as a "field emission cathode" or "field emission element" in the art.

Recently, development of semiconductor fine-processing techniques permits a field emission cathode (hereinafter also referred to as "FEC") of the surface emission type to be constructed of field emission cathode elements having a size as small as microns. Arrangement of the thus-constructed field emission cathodes in large numbers on a substrate is expected to permit the field emission cathodes to act as an electron source for a display device of the flat type or various electronic devices.

Such a conventional field emission cathode is typically represented by an field emission cathode (FEC) of the Spindt type by way of example, which is generally constructed in such a manner as shown in FIG. 4.

More particularly, the FEC includes a substrate 100 on which a cathode electrode layer 101 is formed. Then, the cathode electrode layer 101 is depositedly formed thereon with a resitive layer 102, an insulating layer 103 and a gate electrode 104 in a film-like manner in order. The insulating layer 103 is formed with holes, in each of which an emitter 115 of a conical shape is arranged in a manner to be exposed at a tip end thereof through each of apertures of the gate electrode layer 104 formed so as to respectively communicate with the holes of the insulating layer 103.

Use of fine processing tehcniques for manufacturing of such an FEC permits a distance between the conical emitters 115 and the gate electrode layer 104 to be reduced to a level lower than a micron, so that application of a voltage as low as tens of volts between the conical emitters 115 and the gate electrode layer 104 permits the conical emitters 115 to discharge electrons.

Thus, when voltages VGE and VA are applied to a display device wherein an anode substrate 116 having a phosphor material deposited thereon is arranged above the substrate 100 on which a number of FECs are arranged in an array as shown in FIG. 4, electrons emitted from the FECs are permited to impinge on the phosphor material, resulting in the phosphor material emitting light.

Now, reasons for which the resistive layer 102 is arranged between the conical emitters 115 and the cathode electrode layer 101 will be described hereinafter.

A distance between the conical emitters 115 and gate electrodes is highly decreased, to thereby often cause short-circuiting therebetween due to dust or the like entering a gap therebetween during manufactuing of the display device. When such short-circuiting occurs even in one place, application of a voltage between the gate electrode and the conical emitters is failed, leading to a failure in operation of the display device.

Also, the FEC locally produces gas during initial operation thereof, which gas often causes discharge to occur between the conical emitters and the gate electrodes or anode electrodes, resulting in a large amount of current flowing through the cathode electrodes, leading to breakage of the cathode electrodes.

Further, of a number of conical emitters, conical emitters apt to easily emit electrons concentratedly carries out emission of electrons, so that a current is caused to focus on the conical emitters. This results in excessively bright spots often occurring on an image plane.

The resistive layer 102 arranged between the conical emitters 115 and the cathode electrode layer 101 as described above, when certain conical emitters 115 excessively emit electrons, permits a voltage drop to occur in a direction of restraining excessive emission of electrons from the conical emitters 115 depending on an increase in current flowing to the conical emitters 115, resulting in excessive emittion of electrons from the emitters being substantially prevented. Thus, arrangement of the resistive layer 102 contributes to an increase in yields of the FECs manufactured and stable operation of the display device.

Now, manufacturing of the FEC of the spindt type constructed as described above will be described hereinafter with reference to FIGS. 5(*a*) to 5(*e*) by way of example.

First, as shown in FIG. 5(*a*), the substrate 100 made of glass or the like is formed thereon with a film of niobium (Nb), resulting in the conductive layer 101 in the form of a thin film being provided thereon. Thereafter, $\alpha$-Si (amorphous silicon) doped with an impurity is deposited in the form of a film on the thin film conductive layer 101 by chemical vapor deposition (CVD), to thereby provide the resistive layer 102 and then $SiO_2$ (silicon dioxide) is deposited in the form of a film on the resistive layer 102, to thereby provide the insulating layer 103. Subsequently, Nb is deposited in the form of a film on the insulating layer 103 by sputtering, to thereby provide the gate electrode layer 104, resulting in a laminate being provided.

Then, a photoresist layer 111 is applied onto the gate electrode layer 104 which is a frontmost or uppermost layer of the laminate and then a mask 112 is arranged on the photoresist layer 111, followed by patterning of the photoresist layer 111 by photolithography, resulting in an aperture pattern being formed on the photoresist layer 111.

Subsequently, the laminate is subject to anisotropic etching by means of any suitable gas such as $SF_6$ or the like on a side thereof on which the photoresist layer 111 is deposited. For this purpose, reactive ion etching (RIE) is employed. This results in the gate electrode layer 104 being formed with apertures 113 of the same pattern as the aperture pattern of the photoresist layer 111, as shown in FIG. 5(*b*).

Thereafter, the lamitate is subject to dry etching, leading to anisotropic etching of the insulating layer 103. This results in the insulating layer 103 being formed with holes 114 as shown in FIG. 5(*c*). Then, the laminate is subject to oblique deposition of aluminum (Al) by vapor deposition while being rotated in the same plane. This results in Al being selectively applied onto only a surface of the gate electrode layer 104 as shown in FIG. 5(*c*) while being kept from being deposited in the holes 114, resulting in a peel layer 105 being formed.

Then, the laminate is depositedly formed on a side thereof on which the holes 114 are provided with molybdenum (Mo) for emitters. This results in Mo for the emitters being not only formed in the holes 114 while being deposited on the resistive layer 102, but deposited on the peel layer 105 as shown in FIG. 5(*d*). Mo deposited on the peel layer 105 is designated at reference numeral 106, so that the emitter material or Mo 106 deposited on the peel layer 105 closes the apertures and the emitter material or Mo deposited on the resistive layer 102 forms the conical emitters 115.

Then, the laminate is immersed in a phosphoric acid solution for dissolving the peel layer 105, so that the peel layer 105 and emitter material 106 on the gate electrode layer 104 may be removed, resulting in an FEC which has such a configuration as shown in FIG. 5(*e*) being provided.

When the conical emitters 115 are formed on the resistive layer 102 as shown in FIG. 4, a resistance between each of cathode wirings for the cathode electrode layer 101 and each of the conical emitters 115 is often veried depending on a distance between the cathode wiring and the conical emitter. More particularly, a resistance between each of the cathode wirings and each of the conical emitters 115 arranged in proximity to the cathode wirings is reduced, whereas that between each of the cathode wirings and each of the conical emitters 115 positioned in the middle of the conical emitter group, to thereby be apart from the cathode wirings is increased. This causes emission of electrons from the conical emitters arranged in proximity to the cathode wirings to be increased and that from the conical emitters away from the cathode wirings to be decreased, so that electron emission of the conical emitters is rendered non-uniform.

In order to eliminate such a disadvantage, the assignee proposed an FEC in which cathode electrodes are arranged in an island-like manner, as disclosed in Japanese Patent Application No. 20923/1993. The FEC proposed is constructed in such a manner as shown in FIG. 6. More particularly, a substrate 100 includes a cathode wiring region on which cathode wirings 121 are arranged. The region is formed with scooped-out portions, in which island-like cathode electrodes 122 are arranged while being separated from the cathode wirings 121. Then, a plurlaity of conical emitters 126 for each emitter group are arranged above each of the island-like cathode electrodes 122 in a manner to positionally correspond thereto. Such construction permits a resistance between each of the cathode wirings and each of the conical emitters 126 for each emitter group to be uniform, so that electron emission of the conical emitters may be rendered uniform.

The FEC constructed as shown in FIG. 4 causes the resistive layer 102 made of α-Si to be reduced in resistance, resulting in an emission current discharged from the conical emitters 115 being increased with an increase in enveronmetal temperature. Such characteristics of the FEC causes various disadvantages to be exhibited when a display device including such FECs is arranged on a vehicle mounted equipment, because the equipment is substantially increased in temperature variation.

Also, when formation of the holes 114 in the insulating layer 102 in manufacturing of the FEC is carried out by dry etching as shown in FIG. 5(*c*), the resistive layer 102 made of α-Si is caused to be partially etched. This causes a surface of the resistive layer 102 made of α-Si to be deteriorated, resulting in a failure in satisfactory adhesion between the resistive layer 102 and the conical emitters 115 formed on the resistive layer 102, leading to a problem of causing the conical emitters 115 to be easily peeled from the resitive layer 102.

Further, the FEC having the cathode electrodes arranged in an island-like manner as shown in FIG. 6 is varied in field emission characteristics depending on a resistance between the conical emitters 125 and the island-like cathode electrodes 122 and that between the island-like cathode electrodes 122 and the cathode wirings 121. More particularly, a decrease in resistance between the conical emitters 126 and the island-like cathode electrodes 122 causes uniformity of an emission current discharged from the conical emitters to be deteriorated, whereas an increase in resistance therebetween causes a voltage across a gate electrode 125 acting as a lead-out electrode to be increased.

An approach to the problem is proposed which is constructed in such a manner that a resistive layer 123 is made of a material increased in resistivity to increase a resistance between the conical emitters 126 and the island-like cathode electrodes 122 and a gap between the cathode wirings 121 and the island cathode electrodes 122 is reduced to decrease a resistance between the cathode wirings 121 and the island cathode electrodes 122. Unfortunately, the approach requires fine processing, to thereby render a manufacturing process of the FEC highly complicated.

Also, another approach is proposed which is adapted to increase a thickness of the resistive layer 123. The approach provides substantially the same advantage as in an increase in resistivity of the resistive layer 123. However, step coverage characteristics of an insulating layer 124, the gate electrode layer 125 and the like render practicing of the approach substantially impossible.

SUMMARY OF THE INVENTION

The present invention has been made in view of the foregoing disadvantages of the prior art.

Accordingly, it is an object of the present invention to provide a field emission cathode which is capable of effectively preventing an increase in emission current discharged from conical emitters due to a variation in environmental temperature.

It is another object of the present invention to provide a method for manufacturing a field emission cathode which is capable of effectively preventing an increase in emission current discharged from conical emitters due to a variation in environmental temperature.

In accordance with one aspect of the present invention, a field emission cathode is provided. The field emission cathode includes a substrate, on which a cathode electrode layer, a resistive layer structure, an insulating layer and a gate electrode layer are arranged in order on the substrate, resulting in cooperating with the substrate to provide a laminate. The gate electrode layer and insulating layer are formed with holes in a manner to be common to both. The field emission cathode also includes emitters arranged in the holes, respectively. The resistive layer structure is constructed of at least two resistive layers different in temperature characteristics from each other.

In a preferred embodiment of the present invention, the resistive layer structure has an uppermost layer made of a resistive material exhibiting resistance to dry etching.

Also, in accordance with this aspect of the present ivnention, a field emission cathode is provided. The field emission cathode includes a substrate provided thereon with a cathode wiring region on which cathode wirings are arranged. The cathode wiring region of the substrate has cathode conductors arranged thereon in a manner to be separated from the cathode wirings. The field emission cathode also includes a resitive layer structure, an insulating layer and a gate electrode layer arranged in order on the substrate so as to cover the cathode wirings and cathode conductors, resulting in cooperating with the substrate to provide a laminate. The gate electrode layer and insulating layer are formed with holes. The field emission cathode further includes emitters arranged in the holes, respectively. The resistive layer structure is constructed of at least two resistive layers different in resistivity from each other.

In a preferred embodiment of the present invention, the resistive layer structure is so constructed that a resistance thereof between the cathode conductors and the emitters is set to be larger than that between the cathode wirings and the cathode conductors.

In a preferred embodiment of the present invention, the resistive layers of the resistive layer structure are made of materials different in temperature characteristics from each other, respectively.

In accordance with another aspect of the present invention, a method for manufacturing a field emission cathode is provided. The method comprises the steps of providing a substrate and laminatedly arranging at least a cathode electrode layer, a resistive layer structure, an insulating layer, a gate electrode layer on the substrate in order, to thereby provide a laminate. The resistive layer structure has an uppermost layer made of a resistive material exhibiting resistance to dry etching. The method further comprises the steps of forming the gate electrode layer and insulating layer with holes by dry etching and arranging emitters in the holes, respectively.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein:

FIG. 5(*b*) is an illustration of the laminate in FIG. 5(*a*) having an aperature;

FIG. 5(*c*) is an illustration of the laminate in FIG. 5(*b*) with holes formed in an insulating layer;

FIG. 5(*d*) is an illustration of the laminate in FIG. 5(*c*) with a conical emitter formed on a resistive layer and a deposit on a peel layer;

FIG. 5(*e*) is an illustration of the laminate in FIG. 5(*d*) with the deposit removed;

DETAILED DESCRIPTION OF THE PREFERRED EMBODIMENTS

Now, the present invention will be described hereinafter with reference to the accompanying drawings.

Figure 1:
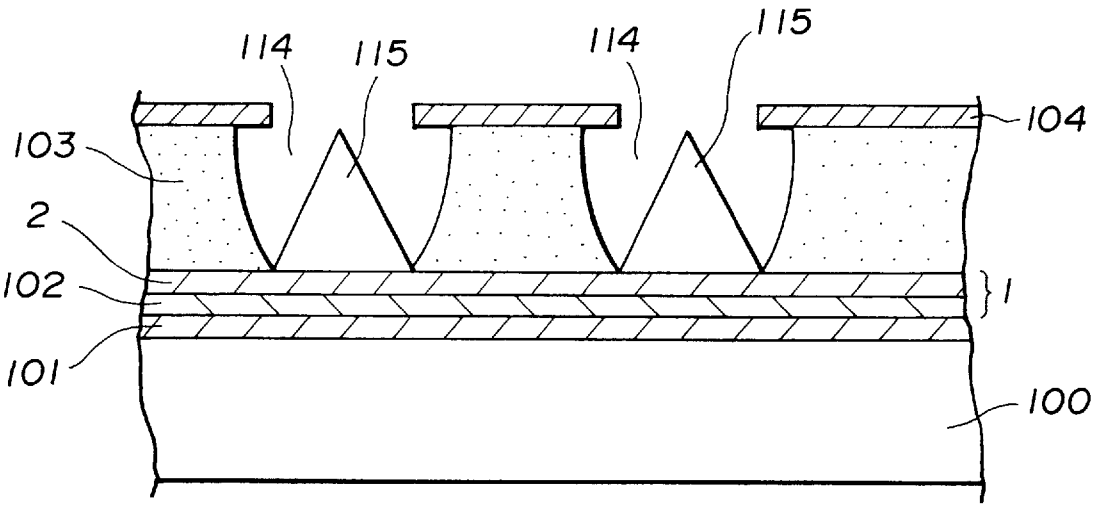
FIG. 1 is a fragmentary sectional view schematically showing an embodiment of a field emission cathode according to the present invention.
Figure 2C:
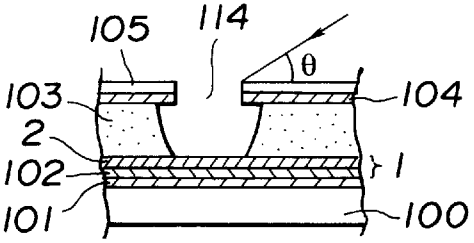
FIGS. 2(*a*) to 2(*e*) each are a fragmentary sectional view showing each of steps in manufacturing of the field emission cathode shown in FIG. 1.
Figure 2B:
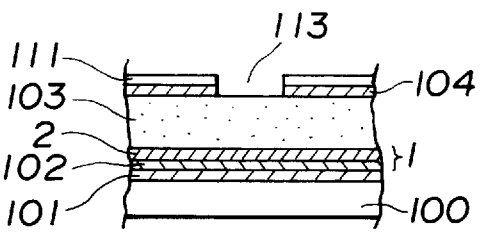
Figure 2A:
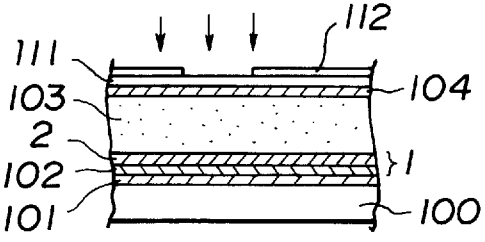
Figure 2E:
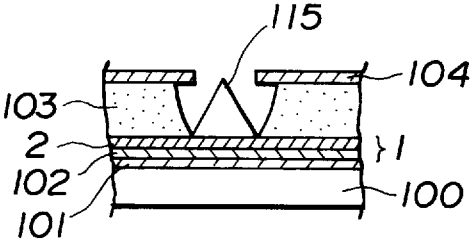
Figure 2D:
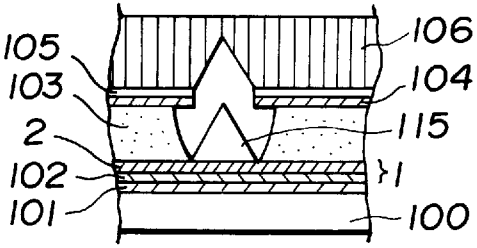

Referring first to FIG. 1, an embodiment of a field emission cathode according to the present invention is illustrated. A field emission cathode (FEC) of the illustrated embodiment includes a glass substrate 100, on which a cathode electrode layer 101 made of niobium (Nb) into a film-like configuration is deposited. Then, the cathode electrode layer 101 is formed thereon with a first resistive layer 102. The first resistive layer 102 is made of α-Si (amorphous silicon) doped with an impurity or the like into a film-like shape. The FEC of the illustrated embodiment also includes a second resistive layer 2 made of a material different in temperature characteristics from the first resistive layer 102 such as chromium oxide ($Cr_2O_3$) or the like into a film-like shape and arranged on the first resistive layer 102. The thus-formed first resitive layer 102 and second resistive layer 2 cooperate with each other to constitute a resistive layer structure 1.

The FEC of the illustrated embodiment further includes an insulating layer 103 formed of silicon dioxide ($SiO_2$) and arranged on the second resitive layer 2 of the resistive layer structure 1. The insulating layer 103 is formed with holes 114, in which conical emitters 115 are arranged while being placed on the second resistive layer 2, respectively. The conical emitters 115 each are made of any suitable material such as a high-melting metal material, a carbon material, nitride, a silicon compound, carbide or the like. Also, the insulating layer 103 is formed thereon with a gate electrode 104, which is made of Nb.

In the FEC of the illustrated embodiment thus constructed, as described above, the resistive layer structure 1 is constituted by the first resitive layer 102 made of α-Si and the second resistive layer 2 made of a material such as $Cr_2O_3$ or the like which is different in temperature characteristics from the first resistive layer 102.

Also, the resistive layer structure 1 is constructed so as to have a resistance thereof set at a predetermined value by varying a thickness of the first resistive layer 102 or second resistive layer 2 in view of resistivity of each of the first and second resistive layers 102 and 2. Thus, even when an increase in environmental temperature causes a resistance of the first resistive layer 102 to be reduced, it causes that of the second resistive layer 2 to be increased, resulting in restraining an increase in emission current radiated or discharged from the conical emitters 115.

Resistive materials used for the second resistive layer 2 include in addition to $Cr_2O_3$ described above, tantalum nitride (TaN), di-tantalum nitride ($Ta_2N$), strontium dioxide ($SrO_2$), Cr—$SiO_2$, tin dioxide ($SnO_2$), ruthenium dioxide ($RuO_2$), nickel-chromium (Ni-Cr) compounds, zinc-titanium-nickel (Zn-Ti-Ni) compounds, zinc-titanium-nicke (Zn-Ti-Ni) oxides, a $BaTiO_3$ compound and the like.

Now, manufacturing of the thus-constructed FEC of the illustrated embodiment will be described hereinafter with reference to FIGS. 2(*a*) to 2(*e*).

First, as shown in FIG. 2(*a*), Nb which is a cathode material is deposited in the form of a film on the substrate 100 made of glass or the like by sputtering, resulting in the cathode electrode layer 101 being formed on the substrate 100. Then, the first resistive layer 102 is formed of a silicon (Si) material such as α-Si doped with an impurity or the like in a film-like manner on the cathode electrode layer 101 and then the second resistive layer 2 is formed of $Cr_2O_3$ or the like in a film-like manner on the first resistive layer 102 by CVD, resulting in the resistive layer structure 1 being provided. A material for the second resitive layer 2 such as $Cr_2O_3$ or the like is preferably resistant to etching gas such as, for example, $SF_6$, $CHF_3$ or the like which is used for etching of silicon oxide.

Then, $SiO_2$ is deposited in the form of a film on the second resitive layer 2 by CVD, resulting in formation of the insulating layer 103 on the second resistive layer 2, followed by deposition of Nb or the like for the gate electrode layer 104 on the insulating layer 103 by sputtering, so that a laminate is provided.

Subsequently, a photoresist layer 111 is applied onto the gate electrode layer 104 which is an uppermost or frontmost layer of the thus-formed laminate and then covered with a mask 112, followed by patterning of the photoresist layer 111 by photolithography, so that the photoresist layer 111 is formed with an aperture pattern.

Thereafter, the laminate is subject on a side thereof on which the photoresist layer 111 is formed to anisotropic etching by means of gas such as $SF_6$ or the like, so that the gate electrode layer 104 is formed with apertures 113 of a pattern substantially identical with the aperture pattern of the photoresist layer 111 as shown in FIG. 2(*b*). The anisotropic etching may be carried out using reactive ion etching (RIE). Then, the laminate thus formed with the apertures is subject to dry etching by means of $CHF_3+O_2$ or the like, so that the insulating layer 103 is subject to anisotropic etching.

This results in the insulating layer 103 being formed with the holes 114 as shown in FIG. 2(*c*). Then, aluminum (Al), nickel (Ni) or the like for a peel layer 105 is obliquely deposited on the laminate while rotating the laminate in the same plane, so that the peel layer 105 is selectively deposited on only a surface of the gate electrode layer 104 while being kept from being deposited in the holes 114.

Then, a high-melting metal material for the above-described conical emitters 115 such as molybdenum (Mo) or the like is deposited in the holes 114 while being put on the second resistive layer 2. This results in Mo being formed on the second resistive layer 2, as well as on the peel layer 105 as indicated at reference numeral 106 in FIG. 2(*d*). The emitter material or Mo 106 deposited on the peel layer 105 closes the holes 114 and the emitter material deposited on the resistive layer 2 forms the conical emitters 115.

Thereafter, the laminate is immersed in a phosphoric acid solution for dissolving the peel layer 105, so that the plle layer 105 on the gate electrode layer 105 and the emitter material 106 are removed, resulting in the FEC being provided as shown in FIG. 2(*e*).

As described above, in manufacturing of the FEC of the illustrated embodiment, the uppermost layer of the resistive layer structure 1 is constituted by the second resitive layer 2 exhibiting resistance to dry etching. Thus, the second resistive layer 2 acts as a stop layer while the insulating layer 103 is formed with the holes 114 by dry etching, so that a surface of the first resistive layer 102 made of α-Si or the like is effectively prevented from being deteriorated by the dry etching. Thus, the present invention permits all etching treatments to be carried out using dry etching.

Figure 3:
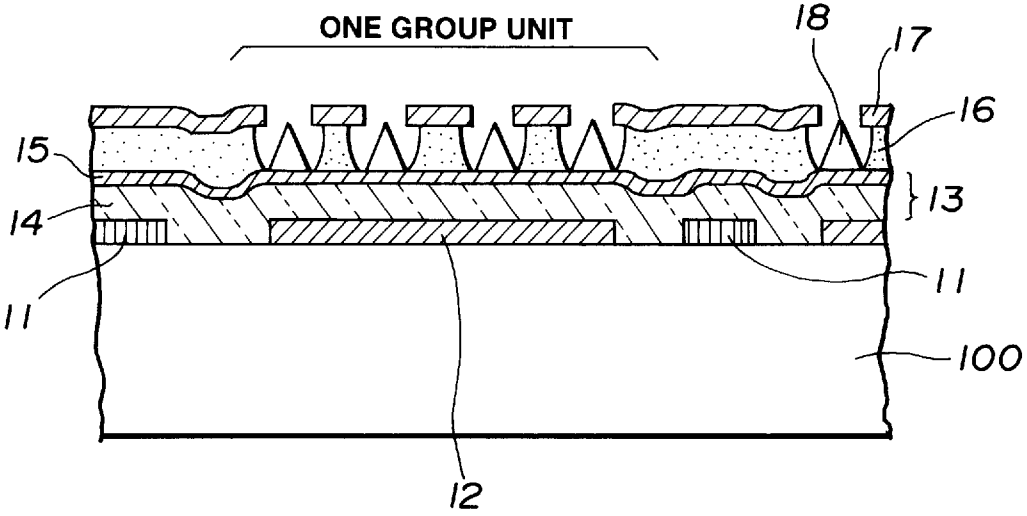
FIG. 3 is a frangmentary sectional view showing another embodiment of a field emission cathode according to the present invention which includes cathode conductors arranged in an island-like manner.
Figure 4:
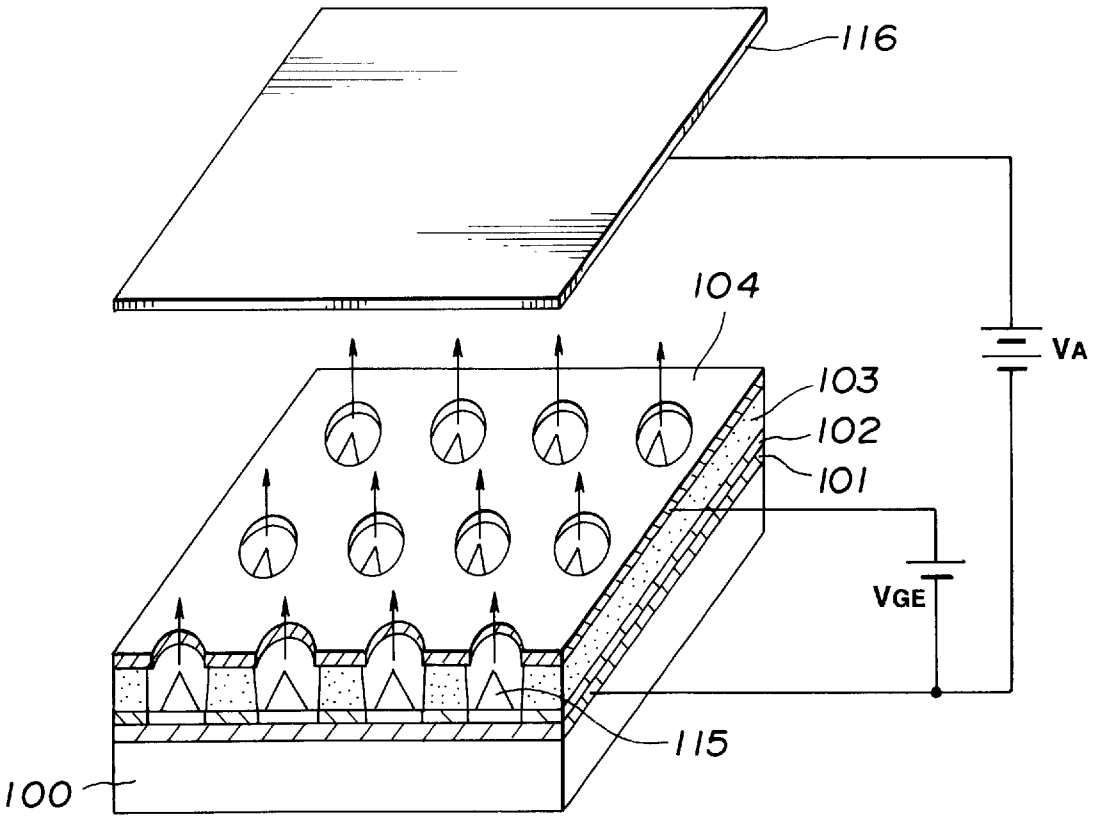
FIG.4 PRIOR ART
FIG. 4 is an exploded perspective view showing a display device in which an array of FECs is arranged.
Figure 5A:
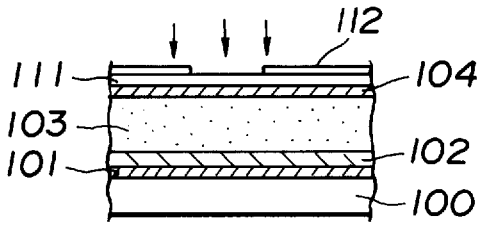
FIG.5(a) PRIOR ART
FIG. 5(*a*) is an illustration of a laminate utilized in manufacturing an FEC.
Figure 5B:
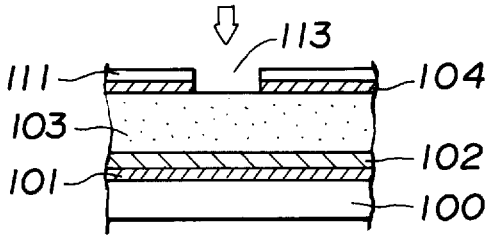
FIG.5(b) PRIOR ART
Figure 5C:
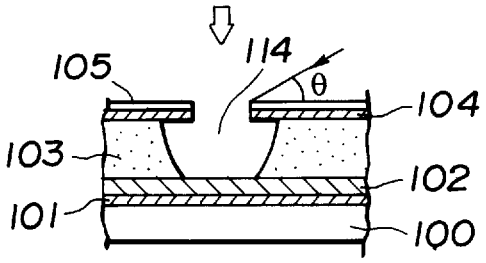
FIG.5(c) PRIOR ART
Figure 5D:
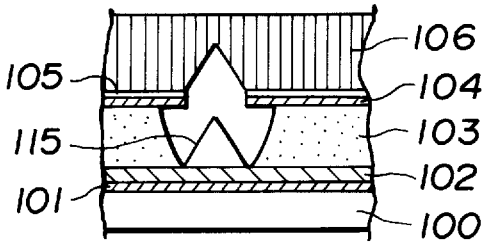
FIG.5(d) PRIOR ART
Figure 5E:
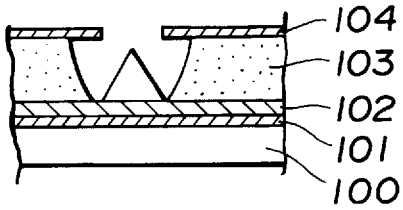
FIG.5(e) PRIOR ART
Figure 6:
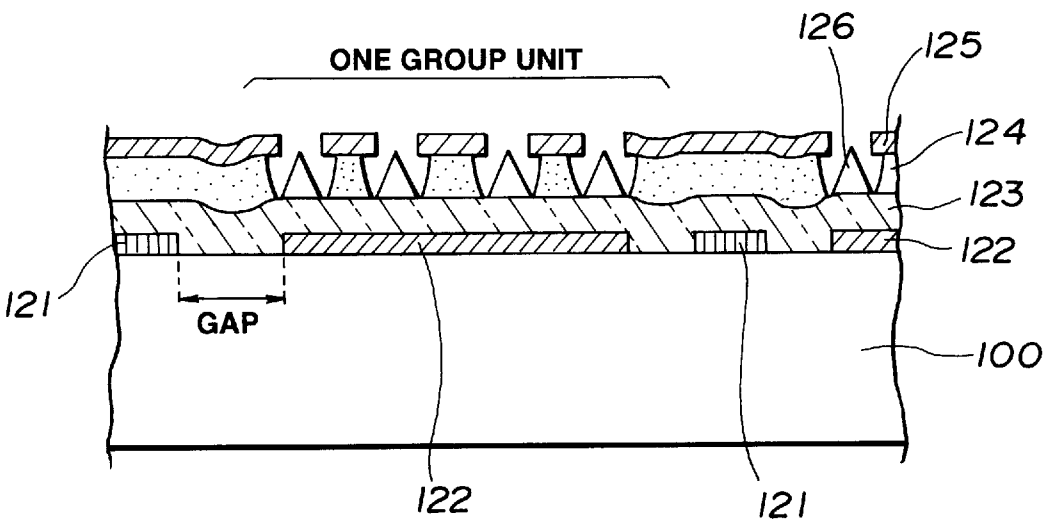
FIG.6 PRIOR ART
FIG. 6 is a fragmentary sectional view showing a conventional field emission cathode including electrodes arranged in an island-like manner.

Referring now to FIG. 3, another embodiment of a field emission cathode (FEC) according to the present invention is illustrated, wherein cathode conductor are arranged in an island-like manner. A field emission cathode of the illustrated embodiment includes an insulating substrate 100, on which cathode wirings 11 and island-like cathode conductors 12 are arranged in a predetermined pattern. The cathode wirings 11 and island-like cathode conductors 12 each may be formed of a thin film made of a conductive material such as Nb, Mo, Al or the like. The FEC of the illustrated embodiment also includes a first resistive layer 14 formed of α-Si or the like and deposited in the form of a film on the island-like cathode conductors 12 and cathode wirings 11 so as to extend over a whole region of the cathode wirings 11. Then, the first resistive layer 14 is formed thereon with a second resistive layer 15, which cooperates with the first resistive layer 14 to provide a resistive layer structure 13. The second resistive layer 15 may be made of $Cr_2O_3$ or the like in a film-like manner.

Materials for the first and second resitive layers 14 and 15 may be selected so as to ensure that a resistivity ρ2 of the second resistive layer 15 is set to be larger than a resistivity ρ1 of the first resistive layer 14.

Further, the FEC of the illustrated embodiment includes an insulating layer 16 made of SiO2 and arranged on the second resistive layer 15 and a gate electrode layer 17 made of Nb, Mo, Al, $WSi_2$ or the like and arranged on the insulating layer 16. The gate electrode layer 17 and insulating layer 16 are formed with apertures in a manner to be common to both. The apertures are arranged in a manner to positionally correspond to the island-like cathode conductors 12, so that the apertures corresponding to each of the island-like cathode conductors 12 define each of aperture groups. The apertures of each group each have a conical emitter 18 arranged therein while being on positioned on the resistive layer 13, resulting in each group of conical emitters 18 being constituted.

Thus, the resistive layer structure 13 is constructed of the first resistive layer 14 and second resistive layer 15 into a two-layer structure in such a manner that the first resitive layer 14 exhibits the resistivity ρ1 smaller than the resistivity ρ2 of the second resistive layer 15. Such construction permits a resistance between the conical emitters 18 and the island-like anode conductors 12 to be increased, resulting in an emission current radiated or discharged from the conical emitters 18 being kept uniform and a resistance between the island-like cathode conductors 12 and the cathode wirings 11 being kept reduced while being rendered substantially equal to the resistivity of the first resistive layer 14, so that a necessity of increasing a lead-out voltage of the gate electrode layer 17 may be eliminated.

Also, even when an environmental temperature is increased, the resistive layer structure permits a variation in resistance thereof due to the temperature variation to be minimized, because it is constituted by the first resistive layer 14 made of α-Si and the second resistive layer 15 made of $Cr_2O_3$ different in resistance-temperature characteristics from the first resistive layer 14. Also, the FEC of the illustrated embodiment permits all etching treatments to be carried out by dry etching techniques, because the uppermost layer of the resistive layer structure effectively exhibits resistance to dry etching.

In each of the embodiments described above, the resistive layer structure is constructed into a two-layer structure. Alternatively, it may be constructed into a multi-layer structure formed of three or more layers so that a resistivity of the structure may be more suitably adjusted.

As can be seen from the foregoing, the field emission cathode of the present invention may be so constructed that the resistive layer structure is constituted by a plurality of resistive layers different in temperature characteristics from each other. This minimizes a variation in resistance of the whole resistive layer structure even when an environmental temperature is increased, to thereby effectively restrain a variation in emission current of the conical emitters due to a temperature variation.

Also, the FEC of the present invention may be so constructed that the resistive layer structure is constituted by at least two resistive layers different in resistivity from each other, to thereby render a resistance between the cathode conductors and the conical emitters larger than a resistance between the cathode wirings and the cathode conductors. This permits the emission current to be kept uniform while preventing an increase in lead-out voltage of the gate electrode layer.

Further, the method of the present invention permits all etching treatments to be carried out by dry etching techniques because the uppermost layer of the resistive layer structure is made of a material exhibiting resistance to dry etching, to thereby simplify and stabilize manufacturing of the FEC.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A field emission cathode comprising:

a substrate;

a cathode electrode layer, a resistive layer structure, an insulating layer, and a gate electrode layer arranged in order on said substrate and cooperating with said substrate to provide a laminate;

holes formed in said gate electrode layer and said insulating layer; and at least one emitter arranged in at least one of said holes;

wherein said resistive layer structure is constructed of at least two resistive layers different in temperature characteristics from each other.

2. The field emission cathode according to claim 1, wherein said resistive layer structure has an uppermost layer made of resistive material exhibiting resistance to dry etching.

3. A field emission cathode comprising:

a substrate having a cathode wiring region thereon;

cathode wirings arranged on said cathode wiring region;

cathode conductors arranged on said cathode wiring region and separated from said cathode wirings;

a resistive layer structure, an insulating layer, and a gate electrode layer arranged in order on said substrate so as to cover said cathode wirings and said cathode conductors, and cooperating with said substrate to provide a laminate;

holes formed in said gate electrode layer and insulating layer; and at least one emitter arranged in at least one of said holes;

wherein said resistive layer structure is constructed of at least two resistive layers different in resistivity from each other.

4. The field emission cathode according to claim 3, wherein said resistive layer structure is so constructed that a resistance between said cathode conductors and said emitters is set to be larger than a resistance between said cathode wirings and said cathode conductors.

5. The field emission cathode according to claim 3, wherein said resistive layer structure has an uppermost layer made of a resistive material exhibiting resistance to dry etching.

6. The field emission cathode according to claim 3, wherein said at least two resistive layers of said resistive layer structure are made of materials having temperature characteristics different from each other respectively.

* * * * *